US009410737B2

(12) United States Patent
Mak et al.

(10) Patent No.: US 9,410,737 B2
(45) Date of Patent: Aug. 9, 2016

(54) NGL RECOVERY METHODS AND CONFIGURATIONS

(75) Inventors: John Mak, Santa Ana, CA (US); Richard B. Nielsen, Laguna Niguel, CA (US); Curt Graham, Mission Viejo, CA (US)

(73) Assignee: Fluor Corporation, Sugar Land, TX (US)

( * ) Notice: Subject to any disclaimer, the term of this patent is extended or adjusted under 35 U.S.C. 154(b) by 1771 days.

(21) Appl. No.: 11/917,392

(22) PCT Filed: Jul. 20, 2006

(86) PCT No.: PCT/US2006/028471

§ 371 (c)(1), (2), (4) Date: Oct. 13, 2009

(87) PCT Pub. No.: WO2007/014069

PCT Pub. Date: Feb. 1, 2007

(65) Prior Publication Data

US 2010/0043488 A1 Feb. 25, 2010

Related U.S. Application Data

(60) Provisional application No. 60/702,516, filed on Jul. 25, 2005.

(51) Int. Cl.
*F25J 3/00* (2006.01)
*F25J 3/02* (2006.01)

(52) U.S. Cl.
CPC ..... *F25J 3/0209* (2013.01); *F25J 3/0233* (2013.01); *F25J 3/0238* (2013.01); *F25J 2200/02* (2013.01); *F25J 2200/70* (2013.01); *F25J 2200/76* (2013.01); *F25J 2205/04* (2013.01); *F25J 2210/06* (2013.01); *F25J 2215/60* (2013.01); *F25J 2220/66* (2013.01); (Continued)

(58) Field of Classification Search
CPC ..... F25J 3/0209; F25J 3/0233; F25J 3/0238; F25J 2200/02; F25J 2200/70; F25J 2200/76; F25J 2210/60; F25J 2205/04; F25J 2210/06; F25J 2240/02; F25J 2245/02
USPC ..... 62/618–622, 625, 628, 630–632, 637
See application file for complete search history.

(56) References Cited

U.S. PATENT DOCUMENTS 3,355,901 A * 12/1967 Angerhofer ..... 62/656
3,595,782 A * 7/1971 Bucklin et al. ..... 208/340
3,793,157 A * 2/1974 Hobbs et al. ..... 203/2

(Continued)

FOREIGN PATENT DOCUMENTS

WO 2005/045338 A1 5/2005

*Primary Examiner* — Keith Raymond
(74) *Attorney, Agent, or Firm* — Conley Rose, P.C.; Kristin Jordan Harkins

(57) ABSTRACT

Contemplated NGL plants include a feed gas bypass circuit through which a portion of the feed gas is provided downstream to a vapor portion of the feed gas to thereby increase turbo expander inlet temperature and demethanizer temperature. Contemplated configurations are especially advantageous for feed gases with relatively high carbon dioxide content as they entirely avoid carbon dioxide freezing in the demethanizer, provide additional power production by the turboexpander, and recover C2+ components to levels of at least 80% while achieving a low carbon dioxide content in the NGL product.

20 Claims, 4 Drawing Sheets

(52) U.S. Cl.
CPC ..... *F25J2240/02* (2013.01); *F25J 2245/02* (2013.01); *F25J 2280/02* (2013.01)

(56) References Cited

U.S. PATENT DOCUMENTS

| | | | | |
|---|---|---|---|---|
| 4,203,741 | A | 5/1980 | Bellinger et al. | |
| 4,278,457 | A * | 7/1981 | Campbell et al. | 62/621 |
| 4,322,225 | A | 3/1982 | Bellinger et al. | |
| 4,456,461 | A | 6/1984 | Perez | |
| 4,854,955 | A | 8/1989 | Campbell et al. | |
| 5,992,175 | A | 11/1999 | Yao et al. | |
| 6,237,365 | B1 | 5/2001 | Trebble | |
| 6,354,105 | B1 | 3/2002 | Lee et al. | |
| 6,401,486 | B1 | 6/2002 | Lee et al. | |
| 6,516,631 | B1 | 2/2003 | Trebble | |
| 6,564,580 | B2 | 5/2003 | Bowen et al. | |
| 6,578,379 | B2 * | 6/2003 | Paradowski | 62/622 |
| 2004/0159122 | A1 * | 8/2004 | Patel et al. | 62/620 |

* cited by examiner

NGL RECOVERY METHODS AND CONFIGURATIONS

This application claims the benefit of our provisional patent application with the Ser. No. 60/702,516, which was filed Jul. 25, 2005, and which is incorporated by reference herein.

FIELD OF THE INVENTION

Gas processing, and especially gas processing for ethane recovery/propane recovery.

BACKGROUND OF THE INVENTION

Numerous expansion processes are commonly used for hydrocarbon liquids recovery in the gas processing industry, and particularly in the recovery of ethane and propane from high pressure feed gas. Such expansion will provide at least in part for the refrigeration requirement in the hydrocarbon separation process. Additional propane refrigeration may be required where the feed gas pressure is low or where the feed gas contains significant quantity of propane and heavier components.

For example, the feed gas in most known NGL expander plants is cooled and partially condensed by heat exchange with demethanizer overhead vapor, side reboilers, and/or external propane refrigeration. The so formed liquid portion (containing less volatile components) is separated, while the vapor portion is typically split into two portions, with one portion being further chilled and fed to an upper section of the demethanizer while the other portion is typically letdown in pressure in a turbo-expander and fed to a mid section of the demethanizer. Such known configurations are commonly used for feed gas with relatively low $CO_2$ (less than 2%) and relatively high $C_3$+ (greater than 5%) content, and are generally not applicable for feed gas with high $CO_2$ content (greater than 2%) and low $C_3$+ content (less than 2% and typically less than 1%).

However, in many expander processes, the residue gas from the fractionation column still contains significant amounts of ethane and propane hydrocarbons that could be further recovered if chilled to an even lower temperature, or subjected to another rectification stage. Lower temperatures are typically accomplished using a higher expansion ratio across the turbo-expander to thereby lower the column pressure and temperature. Unfortunately, in most common configurations high ethane recovery in excess of 90% is neither achievable due to $CO_2$ freezing in the demethanizer, nor economically justified due to the high capital cost of the compression equipment and energy costs. In other known plants, where configurations were adapted to relatively high propane and heavier recoveries, ethane recovery is typically in the 20% to 50% range.

Exemplary NGL recovery plants with a turbo-expander, feed gas chiller, separators, and a refluxed demethanizer are described, for example, in U.S. Pat. No. 4,854,955 to Campbell et al. Here, a configuration is employed for moderate ethane recovery with turbo-expansion in which the demethanizer column overhead vapor is cooled and condensed by an overhead exchanger using refrigeration generated from feed gas chilling. Such additional cooling step condenses most of the propane and heavier components from the column overhead gas, which is later recovered in a separator, and returned to the column as reflux. Unfortunately, while high propane recovery can be achieved with such processes, ethane recovery is frequently limited to 20% to 50% due to $CO_2$ freezing problems in the demethanizer when processing a high $CO_2$ feed gas.

Most known plants typically require very low temperatures (e.g., −100° F. or lower) in the demethanizer in order to achieve a high ethane recovery. However, as in many high propane recovery configurations, the $CO_2$ content in the top trays will increase due to the very low temperatures, which invariably causes significant internal recycle and accumulation of $CO_2$. Thus, such configurations typically result in high $CO_2$ concentrations in the top trays, and are thus more prone to $CO_2$ freezing, which presents a significant obstacle for continuous operation. Alternatively, $CO_2$ concentration can be reduced in the feed gas to a tolerable limit with the use of amine $CO_2$ removal units. However, such $CO_2$ removal option adds significant cost and energy consumption to the plants.

To circumvent the $CO_2$ freezing problems in the demethanizer of an NGL plant, $CO_2$ can be removed in the NGL fractionation column. For example, U.S. Pat. No. 6,182,469 to Campell et al. discloses a configuration in which a portion of the liquid in the top trays of the demethanizer is withdrawn, heated, and returned to the lower section of the column for $CO_2$ removal and control. While such configuration can remove undesirable $CO_2$ at least to some degree, the fractionation efficiency of the demethanizer is often reduced and additional fractionation trays, heating, and cooling duties must be provided for such processing. Yet another approach for processing feed gas with concurrent $CO_2$ removal is described in U.S. Pat. No. 6,516,631 to Trebble in which deethanizer overhead vapor is recycled to the mid section of the demethanizer for removal of $CO_2$. Such recycle schemes can also be used to reduce $CO_2$ content in the NGL product to at least some degree, but deethanizer vapor recycling requires additional compression, heating, and cooling that often make such configurations economically less attractive.

Thus, numerous attempts have been made to improve the efficiency and economy of processes for separating and recovering ethane and heavier natural gas liquids from natural gas and other sources. However, all or almost all of them are relatively complex and often fail to achieve economic operation for high ethane recovery with high $CO_2$ feed gases. Consequently, there is still a need to provide improved methods and configurations for natural gas liquids recovery.

SUMMARY OF THE INVENTION

The present invention is directed to configurations and methods of NGL production in which the temperature of the vapor feed to the demethanizer (most typically upstream of the turboexpander) increased by combining the vapor feed with a portion of unprocessed feed gas. Such configurations advantageously allow warmer operation of the demethanizer in the upper section, thereby eliminating carbon dioxide freezing under all operations, and further provide an increase in power production by the turboexpander. It should be especially noted that such configurations allow operation of the demethanizer with an optimized temperature gradient, which results in desirable separation characteristics despite higher temperature in the upper section.

In one aspect of the inventive subject matter, a plant includes a feed gas separator that is configured to separate a feed gas into a liquid portion and a vapor portion. A demethanizer is fluidly coupled to the separator and configured to receive the vapor portion and the liquid portion, and a turboexpander is configured to receive and expand at least part of the vapor portion in a location upstream of the demethanizer. In such plants, a feed gas bypass circuit is configured to provide part of the feed gas as a bypass gas to the vapor portion upstream of the demethanizer in an amount sufficient to prevent carbon dioxide freezing in the demethanizer.

Therefore, preferred plants will further comprise a control device configured to variably control flow of the bypass gas as a function of at least one of a temperature of the demethanizer and a temperature of a turboexpander inlet stream. Furthermore, a heat exchanger is included and configured to cool another part of the feed gas using refrigeration content of a demethanizer overhead product to thereby form a demethanizer reflux stream. While not limiting to the inventive subject matter, it is generally preferred that the feed gas separator is configured to receive the bypass gas. Also, where desirable, the plant may include a feed gas cooler that is configured to utilize refrigeration cold of a demethanizer overhead for cooling the feed gas. Alternatively, or additionally, a second bypass may be included that is configured to use a portion of a demethanizer overhead product for chilling, in the production of a demethanizer lean reflux.

In another aspect of the inventive subject matter, a control device includes a processing unit that is electronically coupled to a plurality of temperature sensors and a flow control valve, wherein the plurality of temperature sensors are thermally coupled to at least one of a feed gas stream, a bypass gas stream, a vapor stream of a feed gas separator, and a demethanizer, wherein the flow control valve is coupled to a feed gas bypass circuit that fluidly couples the feed gas stream with a vapor stream in or downstream from the feed gas separator, and wherein the processing unit is configured such that, using the flow control valve, a flow rate of the feed gas through the bypass circuit is a function of a temperature in at least one of the demethanizer and the bypass gas stream.

Typically, the temperature sensors are thermally coupled to the bypass gas stream, the vapor stream of a feed gas separator, and the demethanizer, and/or the bypass circuit is configured to fluidly couple the feed gas stream with the vapor stream in the feed gas separator. Preferably, the processing unit is configured such that the flow rate of the feed gas through the bypass circuit is a function of the temperature in the demethanizer and the bypass gas stream. In many contemplated aspects, ethane recovery in the demethanizer bottom product is at least 80%, and the bottom product has a carbon dioxide content of no more than 10 mol %, more typically no more than 2 mol % and most typically no more than 6%.

Consequently, in a further aspect of the inventive subject matter, a method of separating a feed gas will include a step of providing a feed gas, and separating a first portion of the feed gas into a vapor portion and a liquid portion. In a further step, part of the vapor portion is expanded in a turboexpander, and the expanded part of the vapor portion is fed into a demethanizer. In yet another step, a second portion of the feed gas is combined with the vapor portion upstream of the demethanizer in an amount sufficient to reduce carbon dioxide freezing in the demethanizer.

Most typically, contemplated methods will include a step of determining a temperature of the vapor portion upstream of the demethanizer prior to combination, the vapor portion upstream of the demethanizer after combination, and/or of a tray in the demethanizer. In such methods, a control device is employed that controls the amount of the second portion of the feed gas that is combined with the vapor portion. Thus, the bypass circuit is preferably configured to fluidly couple the feed gas stream with the vapor stream in the feed gas separator. Furthermore, it is generally contemplated that the processing unit is programmed such that the flow rate of the feed gas through the bypass circuit is a function of the temperature in the demethanizer and the bypass gas stream. For example, the control device may be used to control the amount of the second portion of the feed gas that is combined with the vapor portion. Furthermore, a third portion of the feed gas may be used as a demethanizer reflux that is formed using refrigeration cold from the demethanizer overhead product.

Various objects, features, aspects and advantages of the present invention will become more apparent from the following detailed description of preferred embodiments of the invention.

DETAILED DESCRIPTION

Figure 1:
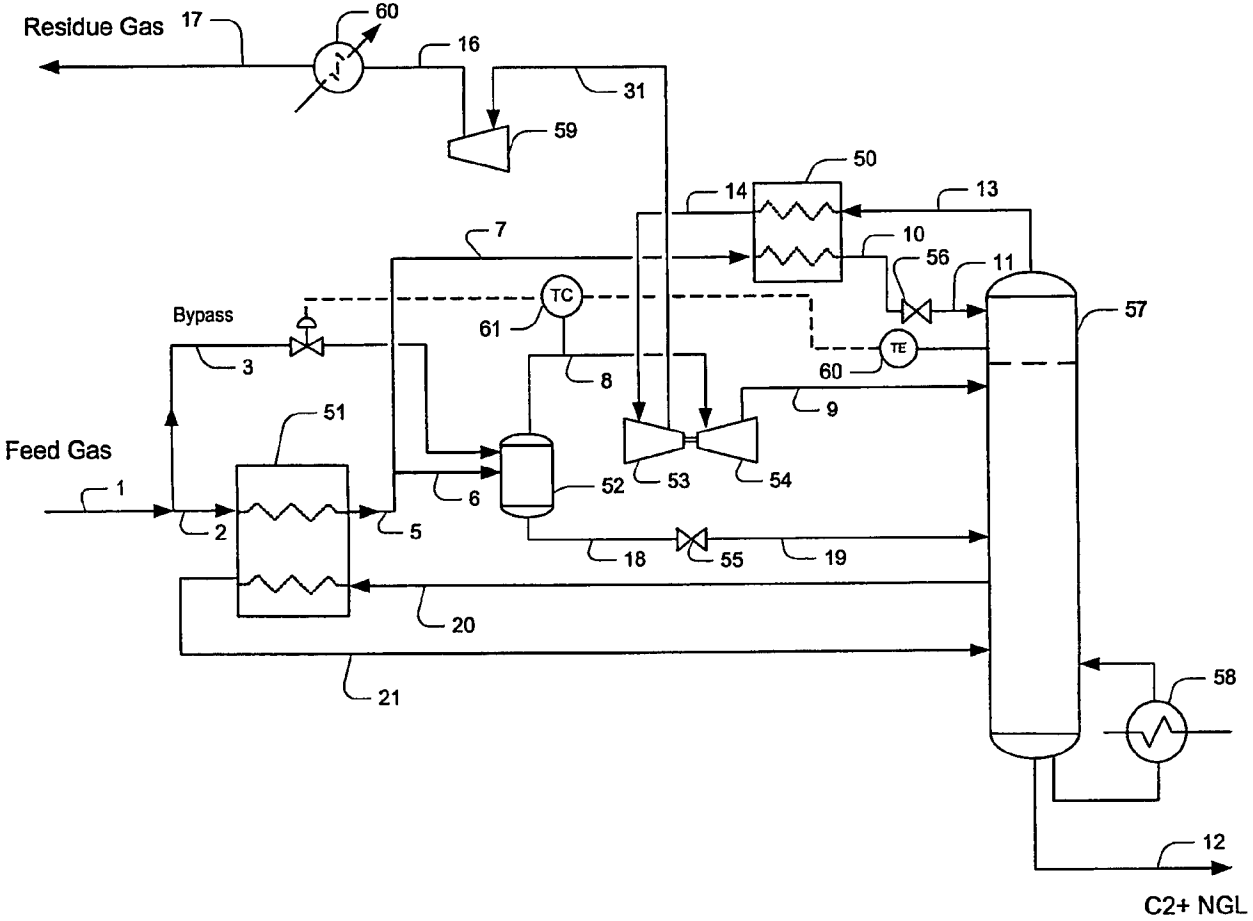
FIG. 1 is a schematic diagram of one exemplary ethane recovery configuration according to the inventive subject matter.

The inventors have discovered that high ethane and propane recovery (e.g., at least 70% to 90% $C_2$, and at least 95% $C_3$) can be achieved where an NGL plant includes a feed gas bypass that controls the inlet temperature to the turboexpander and/or the demethanizer to thereby strip $CO_2$ content from the demethanizer bottom. Contemplated configurations and methods are particularly advantageous where the feed gas has a relatively high $CO_2$ content (e.g., equal or greater than 2 mol %) as such configurations will also avoid $CO_2$ freezing. Furthermore, such configurations and methods will advantageously reduce gas compression power requirement. Viewed from another perspective, it should be appreciated that the use of a feed gas bypass that is coupled to the demethanizer operation will allow stripping of $CO_2$ from the NGL product to no more than 10 mol %, more typically no more than 6 mol % and most typically no more than 2 mol %, thereby reduce $CO_2$ freezing, lower power consumption, and improve NGL recovery.

Preferably, the temperature to the expander is controlled by mixing the vapor portion from the feed gas separator with a portion of the feed gas bypass, and most preferably, mixing is performed to maintain the temperature of the feed into the expander in a superheated state (without liquid formation). It should be appreciated that the resulting higher temperature of the mixed stream (typically between about −20° F. to about 50° F.) is especially advantageous in stripping undesirable $CO_2$ in the demethanizer while increasing the power output from the expander, which in turn reduces the residue gas compression horsepower. Viewed from another perspective, contemplated configurations may be used to remove $CO_2$ from the NGL to low levels typically at 6% or even lower, to reduce energy consumption of the downstream $CO_2$ removal system.

In contrast, the feed gas in currently known expander plant configurations is typically chilled to a low temperature (typically −20° F. to −50° F.), split into two portions, and then separately fed to the demethanizer overhead exchanger (subcooler) and the expander. It should be noted that while such low temperatures improve recovery, they also significantly increase the power consumption of the process, due to the relative lower expander power output, which in turn requires higher residue gas compression horsepower. Still further, such low temperatures also lead to $CO_2$ vapor condensation inside the demethanizer, which has the undesirable effects of promoting $CO_2$ freezing and increasing the $CO_2$ content in the NGL product. Thus, most of the currently known configurations fail to reduce the $CO_2$ content in NGL to 6 mol % or lower, without sacrificing ethane recovery.

In further preferred configurations, chilled feed gas is split into two portions, wherein one portion is mixed with the bypass feed gas forming the warmed expander inlet gas, and wherein the other portion is chilled by demethanizer overhead vapor to thereby form subcooled reflux to the demethanizer. It should be recognized that the flow ratio of the feed gases can be varied (preferably in conjunction with the feed gas bypass controlling the expander inlet temperature) for a desired ethane recovery and $CO_2$ removal. It should also be appreciated that increasing the flow to the demethanizer overhead exchanger increases the reflux rate, thus resulting in a higher ethane recovery. Advantageously, and especially at increased reflux rates, co-absorbed $CO_2$ can be removed by increasing the bypass feed gas flow, which increases the temperature to the expander, which in turn increases the expander discharge temperature that raises the demethanizer tray temperatures to a point above the $CO_2$ freezing point.

The residue gas from the demethanizer is preferably compressed (e.g., by a compressor driven by the feed gas expander, and/or a residue compressor) to the sales gas pipeline pressure. Optionally, for even higher ethane recovery (e.g., 90% to 99%), a portion (about 5% to 40%) of the compressed residue gas is recycled to the demethanizer and will, after being subcooled in the demethanizer overhead exchanger, provide another lean reflux stream. With respect to the liquid condensate from the expander suction drum, especially when processing a rich gas, it is preferred that the liquid is expanded, cooled, and fed to the demethanizer. As used herein in the following examples, the term "about" in conjunction with a numeral refers to a range of that numeral starting from 10% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig.

In a typical example, the feed gas has a relatively high $CO_2$ content and is depleted of $C_4$ and heavier components (e.g., 0.58% $N_2$, 3.0% $CO_2$, 89% $C_1$, 7.0% $C_2$, 0.6% $C_3$, and 0.07% $C_4$+). One preferred configuration, as depicted in FIG. 1, includes a demethanizer that receives the expanded temperature-controlled vapor portion of the feed gas (which is a combination of the chilled feed gas vapor and the feed gas bypass that advantageously controls the expander inlet temperature). It should be noted that the higher expander temperature is utilized for stripping $CO_2$ in the demethanizer while simultaneously avoiding $CO_2$ freezing in the column. It should also be appreciated that the higher expander inlet temperature also increases the expander power output, that is used to drive the re-compressor so connected. Consequently, the residue gas compression horsepower can be significantly reduced.

Here, feed gas stream 1, at 40° F. and 1250 psig, is split into stream 2 and bypass stream 3. Stream 2 is chilled in exchanger 51 forming stream 5, utilizing the refrigerant content in the demethanizer side-draw stream 20 (thereby forming stream 21) while supplying at least a portion of the reboiler heating duty for stripping the undesirable light components in the demethanizer liquid. Optionally, two or more side-draws can be used for even higher efficiency. Stream 5 is split into two portions, stream 6 and 7, typically at a ratio of stream 5 to 7 of about 0.2 to 0.8.

Stream 6 is mixed with the bypass stream 3 in the expander suction drum 52. It is preferred that the expander inlet temperature is controlled using feedback from temperature sensing elements 60 and 61. Optionally, the temperature control set-point can be manually adjusted as necessary to avoid $CO_2$ freezing. An increase in the flow of bypass stream 3 will increase the expander inlet and outlet discharge temperatures, and subsequently increase the demethanizer tray temperatures, thereby increasing stripping of the $CO_2$ from the NGL while eliminating $CO_2$ freezing. Higher expander inlet temperatures also have the side benefits of an increase in power output from the expander, which advantageously reduces the overall energy consumption. Stream 8, which is typically maintained at about −20° F. to 50° F. is expanded in the expander 54 to approximately 510 psig, forming stream 9 typically at −90° F., which is fed to the top trays of demethanizer 57. Stream 7 is chilled in the demethanizer overhead exchanger 50 to about −100° F., using the refrigerant content of the demethanizer overhead vapor stream 13. So formed chilled stream 10 is then JT'd in valve 56 to stream 11 that is fed to the top of the demethanizer 57. The liquid portion 18 from drum 52 is expanded across JT valve 55 to form stream 19, which is subsequently fed to the demethanizer 57.

The demethanizer column 57 is reboiled with heat content from feed gas stream 2 and bottom reboiler 58 (e.g., using external heat or heat from compressed residue gas) to thereby control the methane content in the bottom product at a predetermined quantity (typically 2 wt % or less). The demethanizer 57 produces an overhead vapor stream 13 at about −125° F. and 510 psig, and a bottom stream 12 at about 50° F. and 515 psig. Preferably, the overhead vapor 13 is used to supply feed gas cooling in exchanger 50 and then compressed by re-compressor 53 (as stream 14) that is driven by expander 54 forming stream 31 to about 45° F. and 600 psig. Stream 31 is further compressed by residue gas compressor 59, forming stream 16 at 1260 psig and 150° F., which is typically cooled by ambient cooler 60 to form the residue gas stream 17.

Figure 4:
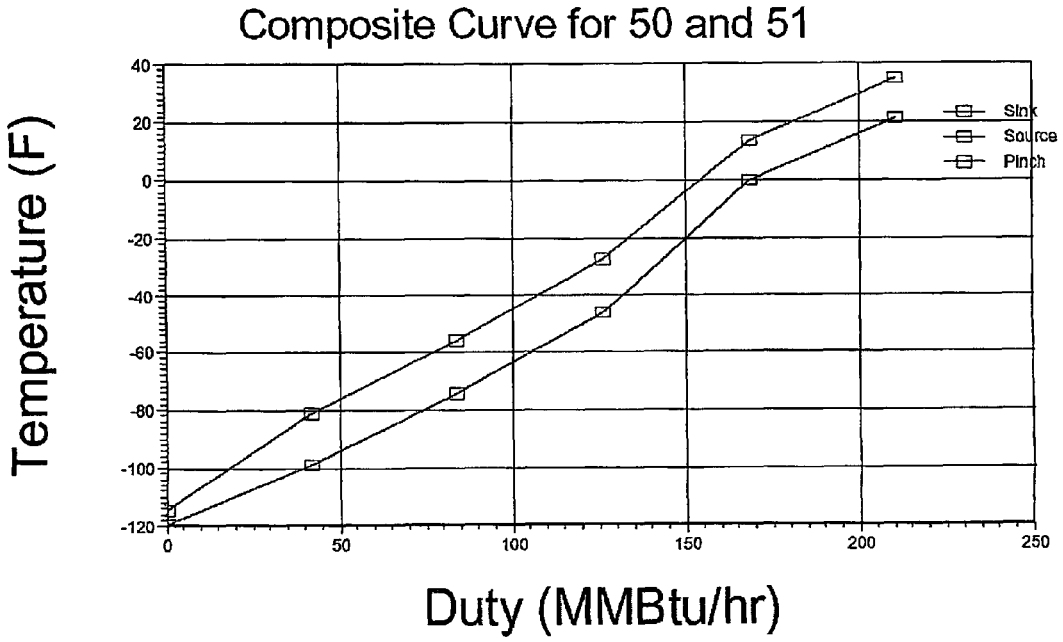
FIG. 4 is a composite curve for exchanger 50 and 51 of the ethane recovery process according to the inventive subject matter.

The high thermal efficiency of contemplated processes and configurations can be easily appreciated from the composite curve of exchangers 50 and 51 as depicted in FIG. 4. Here, the closely parallel heat curves and the close temperature approaches between the heating and cooling curves from contemplated configurations represents a minimization of thermodynamic losses, and hence a remarkably high thermodynamic efficiency using a conceptually simple approach.

Figure 2:
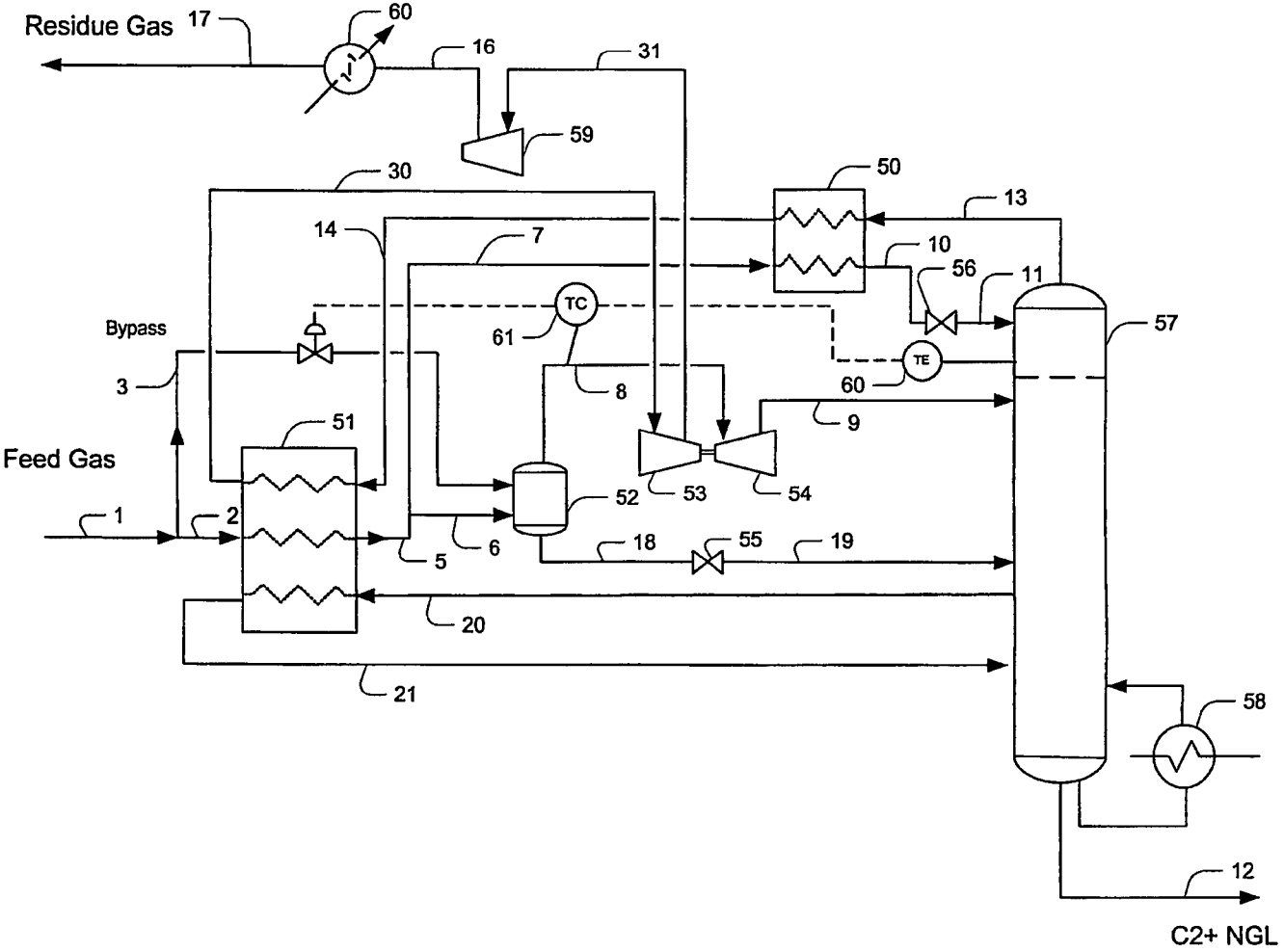
FIG. 2 is a schematic diagram of another exemplary ethane recovery configuration according to the inventive subject matter.

In alternative aspects, and especially where the fed gas comprises relatively large quantities of $C_3$+ components (e.g., between about 2.0% and 6.0% C3+), additional feed gas chilling may be provided as depicted in FIG. 2. Here, the residue gas stream 14 provides refrigeration to the feed gas 2 in exchanger 51 forming stream 30 prior to compression by re-compressor 53. This configuration can be advantageously used to supply additional chilling for feed gas when the feed gas contains a higher concentration of the $C_3$+ components. Other operational parameters and device configurations of the remaining components of the process according to FIG. 2 are similar to the previously described configuration of FIG. 1, and with respect to the remaining components and numbering, the same numerals and considerations as in FIG. 1 above apply.

Figure 3:
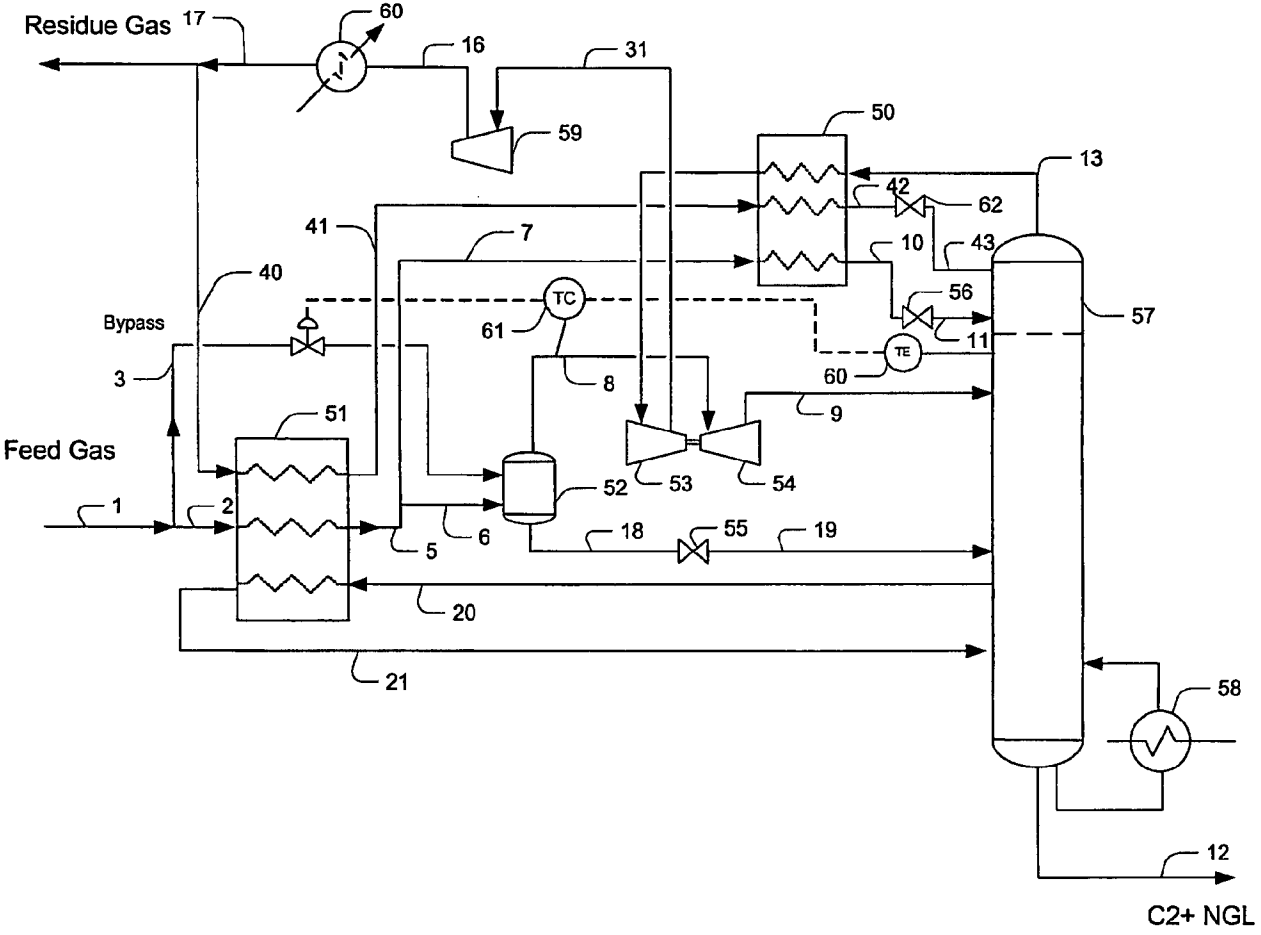
FIG. 3 is a schematic diagram of a further exemplary ethane recovery configuration according to the inventive subject matter.

FIG. 3 shows yet another configuration that can be employed to still further increase ethane recovery level up to 99% (and even higher). Here, lean reflux stream 40 is formed from the residue gas discharge that is chilled in exchanger 51 forming stream 41 and in exchanger 50 forming 42 prior to being JT'd to the top of the demethanizer via JT valve 62 and stream 43. Such configurations can also be used to supply additional chilling where the feed gas contains a higher concentration of the $C_3$+ heavier components (e.g., between about 2.0% and 6.0%, and even higher). As before, operational parameters and device configurations of the remaining components of the process according to FIG. 3 are similar to the configurations described for FIG. 1 above, and with respect to the remaining components and numbering, the same considerations as in FIGS. 1 and 2 apply for the same numerals.

With respect to suitable feed gas streams, it is generally contemplated that various feed gas streams are appropriate, and especially suitable feed gas streams include hydrocarbons of different molecular weight and with different molar composition. Therefore, and among other contemplated feed gases, processed and unprocessed natural gas is particularly preferred. Thus, the molecular weight of hydrocarbons in contemplated feed gases will vary considerably. However, it is generally preferred that the feed gas stream predominantly includes (e.g. at least 90%, and more typically at least 95%) $C_1$-$C_6$ hydrocarbons, $CO_2$, nitrogen and other hydrocarbons and non-hydrocarbon components. The content of hydrocarbons may further vary substantially, but it is typically preferred that the feed gas will include at least 80% methane components, more typically at least 85% methane components, and most typically between 85% and 95% methane components. $C_2$ components will typically be present in a range of between about 1% and about 10%, and more typically between about 3% and about 8%, while $C_3$ components will typically be present in a range of between about 1% and about 6% (and in some cases even more). Higher hydrocarbons (i.e., $C_4$+ components) will preferably be present in an amount of less than 3%, more typically less than 1%, and most typically less than 0.5%.

Suitable feed gas streams may also comprise one or more acid gases, and especially contemplated acid gases include carbon dioxide and hydrogen sulfide. It is contemplated that the feed gas may be unprocessed (e.g., where the feed gas has a composition that is similar or identical to a desirable chemical composition), or that the feed gas may be processed in various manners. For example, contemplated feed gases may have been treated to remove at least some of the acid gas content, $C_4$+ content, and/or water. Therefore, suitable sources of feed gas include associated gas production, non-associated gas production, gas storage reservoirs, gas production from enhanced oil recovery, natural gas treatment plants, and pipeline gas production that produce appreciable quantities of methane and other hydrocarbons. Depending on the feed gas source, it should be appreciated that the feed gas pressure may vary considerably. For example, feed gas pressure may be at pipeline pressure (e.g., about 1000-1400 psig) or even higher. In alternative less preferred aspects, the feed gas pressure may also be between about 500 psig and 1000 psig, and in even less preferred aspects, the feed gas pressure is between 500 psig and 50 psig (or even lower). Therefore, feed gas pressure boosters or compressors are also contemplated.

Most typically, the feed gas in contemplated plants will be at a temperature of between about 20° F. to about 60° F. and thus needs to be cooled in a feed gas chiller to a temperature of between about −10° F. to about −100° F. prior to entering the separator and/or demethanizer (as a reflux stream). For example, feed gas cooling may be performed using refrigeration content of the demethanizer overhead product (before or after recompression), and/or using other sources of refrigeration content from within or outside the plant to further increase recovery of ethane and heavier components. Therefore, and depending on the particular temperature of the feed gas and/or feed gas cooling, the bypass stream may be directly used for temperature control of the vapor portion upstream of the demethanizer or indirectly. For example, the bypass stream may be mixed with the vapor portion of the chilled feed gas in the separator that is downstream of the feed gas chiller, or may be combined with the vapor portion leaving the separator. Alternatively, the bypass stream may also be combined with the expanded vapor portion upstream or at the demethanizer column. In less preferred configurations, it is contemplated that the bypass stream may also be chilled or heated, typically using refrigeration content or heat from a component within the plant.

It should be appreciated that all manners of combining the bypass stream with a vapor portion are generally deemed suitable for use in conjunction with the teachings presented herein. However, in preferred aspects, the bypass stream is combined in the separator located upstream of the turboexpander. Most typically, the flow rate of the bypass stream will be controlled by a control unit that is programmed or otherwise configured to regulate flow of the bypass stream in dependence of the temperature of the demethanizer (typically measured at the upper trays) and/or the combined stream that is fed to the turboexpander. Therefore, multiple temperature sensors will typically be coupled to the control unit. Alternatively, the temperature of the vapor stream upstream of the turboexpander and/or the demethanizer may also be controlled by heat exchange with a warmer process or heat transfer fluid, and the bypass stream may therefore be reduced or even entirely omitted.

In further preferred configurations and methods, the bypass stream is mixed with a portion of a chilled vapor from the feed stream prior to feeding a turbo-expander to provide temperature control of the expander feed. The mixed turbo-expander feed stream is then fed into a turbo-expander and subsequently fed into the demethanizer, wherein a remaining portion of the chilled feed gas is further cooled, preferably using the refrigerant content of the demethanizer overhead product, and then let down in pressure via JT valve before entering the top section of absorber as a reflux stream. Especially suitable devices include Joule-Thomson valves, however, all other known devices and methods to reduce pressure are also considered suitable for use herein. For example, suitable alternative devices might include power recovery turbines and expansion nozzles devices.

With respect to the vapor portions of contemplated configurations and processes, it should be recognized that the reflux vapor portion (e.g., portion of chilled feed gas) is fed into an exchanger that is cooled and condensed by the demethanizer overhead vapor prior to being used as reflux into the column. Furthermore, it is preferred that the column overhead product may act as a refrigerant in at least one, and preferably at least two heat exchangers, wherein the demethanizer overhead product cools at least a portion of the feed gas and/or separated vapor portion. Suitable column types may vary depending on the particular configurations, however, it is generally preferred that the column is a tray or packed bed type column.

It should be especially recognized that the feed gas in contemplated configurations is chilled supplying a subcooled liquid as reflux, and that an expander inlet feed controls $CO_2$ freezing in the column. Thus, it should be appreciated that the cooling requirements for the column are at least partially provided by the reflux streams, and that the $C_2/C_3$ recovery is significantly improved by employing an additional lean reflux stream from residue gas recycle. Using contemplated configurations, $CO_2$ in the NGL product can be economically reduced to lower levels (e.g., reduced by 20-90%, and more typically by 40-80%). With respect to the $C_2$ recovery, it is contemplated that such configurations provide at least 70%, more typically at least 80%, and most typically at least 95% recovery when residue gas recycle is used, while it is contemplated that $C_3$ recovery will be at least 90%, and more typically at least 95%. Further aspects and contemplations for gas treatment configurations and methods are described in our copending International patent application with the publication numbers WO 2005/075056 and WO 2003/100334, both of which are incorporated by reference herein.

Thus, specific embodiments and applications of NGL recovery methods and configurations have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A plant comprising:

a feed gas inlet line configured to receive a feed gas stream having a carbon dioxide content of at least 2 mol %;

a feed gas exchanger that is configured to receive and cool a first portion of the feed gas stream to thereby form a cooled feed gas stream;

a feed gas separator that is configured to receive and separate a first fraction of the cooled feed gas stream into a liquid portion and a superheated vapor portion;

a feed gas bypass circuit that is configured to provide a second portion of the feed gas stream from a position upstream of the feed gas exchanger as a bypass gas stream around the feed gas exchanger, wherein the bypass gas stream is combined with the superheated vapor portion to form a mixed vapor portion;

a turboexpander configured to receive and expand the mixed vapor portion in a location upstream of a demethanizer to produce an expanded vapor portion;

the demethanizer fluidly coupled to the feed gas separator and configured to receive the expanded vapor portion and the liquid portion as demethanizer feed streams, and a second fraction of the cooled feed gas as a demethanizer reflux stream; wherein the expanded vapor portion is fed to the top of the demethanizer, and wherein the bypass gas stream is combined with the superheated vapor portion in an amount sufficient to prevent carbon dioxide from freezing in the demethanizer and to reduce carbon dioxide content in a demethanizer bottom product by increasing temperature of the mixed vapor portion flowing to the turboexpander to maintain between −20 and 50° F.; and a control device that is configured to variably control the flow of the second portion of the feed stream as a function of a temperature of the demethanizer and a temperature of the feed gas.

2. The plant of claim 1 wherein the control device is further configured to variably control flow of the bypass gas as a function of a temperature of a turboexpander inlet stream.

3. The plant of claim 1, further comprising: a heat exchanger that is configured to cool the second fraction of the cooled feed gas using a refrigeration content of a demethanizer overhead product to thereby form the demethanizer reflux stream.

4. The plant of claim 1, wherein the feed gas exchanger is configured to utilize refrigeration content of a demethanizer overhead product for cooling the first portion of the feed gas stream.

5. A control device, comprising:

a processing unit electronically coupled to a plurality of temperature sensors and a flow control valve;

wherein the plurality of temperature sensors are disposed in thermal contact with a superheated vapor stream of a feed gas separator and a demethanizer;

wherein the flow control valve is coupled to a feed gas bypass circuit that fluidly couples the feed gas stream with the feed gas separator, wherein a first portion of the feed gas stream passes through a feed gas exchanger configured to cool the first portion of the feed gas stream, wherein the feed gas bypass circuit is configured to provide a second portion of the feed gas stream from a position upstream of the feed gas exchanger as a bypass gas stream around the feed gas exchanger, and wherein the second portion of the feed gas stream is combined with the superheated vapor stream to form a mixed vapor stream, and wherein the mixed vapor stream is fed to an expander; and wherein the processing unit is configured such that, using the flow control valve, a flow rate of the second portion of the feed gas stream through the feed gas bypass circuit is a function of a temperature in the demethanizer by increasing a temperature of the superheated vapor stream flowing to the expander to maintain the temperature of the superheated vapor stream between −20 and 50° F., such that the expander produces an expanded vapor portion that is fed to a top of the demethanizer.

6. The control device of claim 5 wherein the processing unit is configured such that the flow rate of the second portion of the feed gas stream through the feed gas bypass circuit is effective to prevent carbon dioxide freezing in the demethanizer.

7. The control device of claim 5 wherein the feed gas comprises ethane and wherein ethane recovery from a demethanizer bottom product is at least 80%.

8. The control device of claim 7 wherein the feed gas comprises carbon dioxide, and wherein the carbon dioxide content in the demethanizer bottom product is no more than 10 mol %.

9. A method of separating a feed gas, comprising:

providing a feed gas stream having a carbon dioxide content of at least 2 mol %;

splitting the feed gas stream into a first portion and a second portion;

cooling the first portion of the feed gas stream in an exchanger to form a cooled feed gas;

separating a first fraction of the cooled feed gas in a feed gas separator into a superheated vapor portion and a liquid portion;

controlling a flow of the second portion of the feed gas stream as a function of a temperature in a demethanizer;

combining the second portion of the feed gas stream with the superheated vapor portion to form a mixed vapor portion, wherein the second portion of the feed gas stream bypasses the exchanger;

expanding the mixed vapor portion in a turboexpander to produce an expanded vapor portion;

feeding the expanded vapor portion to a top tray of a demethanizer;

using a second fraction of the cooled feed gas as a reflux stream in the demethanizer;

increasing the temperature of the mixed vapor portion flowing to the turboexpander to between −20 and 50° F. based on the combining of the second portion of the feed gas stream with the superheated vapor portion; and eliminating carbon dioxide freezing in the demethanizer based on the increasing of the temperature of the mixed vapor portion.

10. The method of claim 9, further comprising: a step of measuring a temperature of the mixed vapor portion before the step of expanding part of the mixed vapor portion in the turboexpander or measuring a temperature on a tray in the demethanizer.

11. The method of claim 9, wherein the demethanizer produces a demethanizer overhead product, and wherein the cooling the first portion of the feed gas stream comprises cooling the first portion of the feed gas stream using the demethanizer overhead product in the exchanger.

12. The method of claim 9, wherein the demethanizer produces a demethanizer overhead product, and wherein the demethanizer overhead product is used to provide cooling to a portion of residue gas to thereby form a lean reflux stream to the demethanizer.

13. The method of claim 9 wherein the demethanizer produces a NGL bottom product, and wherein at least 80% of ethane in the feed gas are recovered in the bottom product.

14. The method of claim 9 wherein the demethanizer produces a NGL bottom product, and wherein the carbon dioxide content in the NGL product is no more than 10 mol %.

15. The method of claim 9, further comprising;

drawing a side-draw stream from the demethanizer;

heat exchanging the side-draw stream with the first portion of the feed gas stream in the exchanger;

heating the side-draw stream in the exchanger; and returning the heated side-draw stream to the demethanizer.

16. The method of claim 9, wherein using the second fraction of the cooled feed gas stream as a reflux comprises;

passing the second fraction of the cooled feed gas to a second exchanger;

cooling the second fraction in the second exchanger;

expanding the second fraction downstream of the second exchanger to create a liquid fraction; and passing the expanded second fraction comprising the liquid fraction to the demethanizer.

17. The method of claim 16, wherein the demethanizer produces a demethanizer overhead product stream and wherein cooling the second fraction in the second exchanger comprises: heat exchanging the demethanizer overhead product stream with the second fraction in the second exchanger.

18. The method of claim 17, wherein cooling the first portion of the feed gas stream in the exchanger to form the cooled feed gas comprises: heat exchanging the demethanizer overhead product stream with the first portion of the feed gas stream in the exchanger, wherein the exchanger is downstream of the second exchanger in a demethanizer overhead product line.

19. The method of claim 17, further comprising: splitting the demethanizer overhead product stream into a residue gas stream and a recycle stream, wherein the recycle stream is recycled to the demethanizer as a lean reflux stream.

20. The method of claim 19, further comprising:

heat exchanging the recycle stream with the demethanizer overhead product stream in the second exchanger;

cooling the recycle stream in the second exchanger;

expanding the recycle stream downstream of the second exchanger; and passing the expanded recycle stream to the demethanizer as the lean reflux stream.

* * * * *